United States Patent [19]

Stark et al.

[11] 3,961,742

[45] June 8, 1976

[54] PARALLELEPIPEDAL PACKING CONTAINER

[75] Inventors: Olof Stark, Rydsgard; Kjell Martensson, Malmo, both of Sweden

[73] Assignee: AB Ziristor, Lund, Sweden

[22] Filed: July 2, 1975

[21] Appl. No.: 592,651

Related U.S. Application Data

[63] Continuation of Ser. No. 464,676, April 26, 1974, abandoned.

[30] Foreign Application Priority Data

May 30, 1973 Sweden ..... 7306743

[52] U.S. Cl. ..... 229/17 R; 229/48 R

[51] Int. Cl.[2] ..... B65D 5/72; B65D 5/42

[58] Field of Search ..... 229/17 R, 88, 48 R

[56] References Cited

UNITED STATES PATENTS

| | | | |
|---|---|---|---|
| 2,550,520 | 4/1951 | Bennett | 229/48 R |
| 3,092,248 | 6/1963 | Lane et al. | 229/48 R X |
| 3,172,796 | 3/1965 | Gülker | 229/48 R X |
| 3,190,441 | 6/1965 | Rausing | 229/48 R X |
| 3,795,359 | 3/1974 | Rausing | 229/17 R X |
| 3,797,726 | 3/1974 | Reil | 229/17 R |

*Primary Examiner*—Davis T. Moorhead

*Attorney, Agent, or Firm*—Pierce, Scheffler & Parker

[57] ABSTRACT

In the shaping of a packing container from a tubular blank of paper, involving the use of a tube having a joint of the overlapping type along the longitudinal edge of the web, an improved rigidity of the container is achieved by closing the longitudinal joint of the finished package to take up at least one-fourth of one side wall of the package.

4 Claims, 2 Drawing Figures

PARALLELEPIPEDAL PACKING CONTAINER

Figure 1:
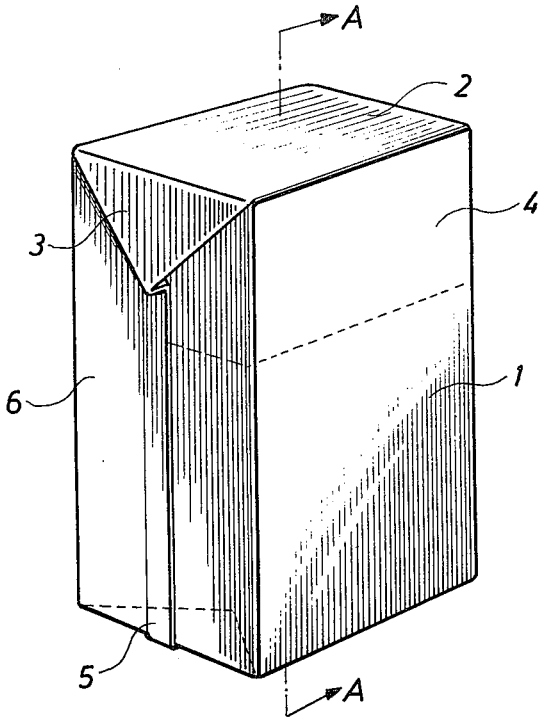

This is a continuation of application Ser. No. 464,676 filed Apr. 26, 1974, and now abandoned.

The present invention relates to a packing container of the type which is manufactured from a web of a plastic-coated packing material, which web is formed into a longitudinal tube in which the longitudinal edges of the web are joined together to form a longitudinal joint, whereupon the tube is filled with the intended contents and is then divided into individual packing units by means of successive, spaced cross-seals perpendicular to the longitudinal axis of the tube, at the same time as the lower part of the tube is subjected to a shaping operation to produce the said parallelepipedal packing units which are then separated from the tube by cutting through the said cross-seals.

The packages may be manufactured from a thermoplastic-coated material web which is formed into a tube, and then cross-sealed to form the parallelepipedic packing containers. Owing to the relatively small thickness of the packing material the packages often become nonrigid and flexible.

The manufacture of the present types of parallelepipedal packages from a material web takes place largely in such a way that the material web is formed into a tube by joining together the longitudinal edges of the material web. This joint or seal may be formed either by joining the edges of the material web together with inside against inside or by overlapping the said edges. After the formation of the tube and after filling, the walls of the tube are sealed together transversely of the longitudinal joint and at spaced distances which correspond substantially to the length of the package. This sealing takes place by heated jaws which are pressed together against the tube filled with its contents, whereby the thermoplastic layer of the material web forms a seal. After transversely sealing the tube is shaped by means of shaping tools especially designed for the purpose which provide two pairs of outwardly projecting opposed triangular, double-walled flaps or lugs, one pair of which are folded in to lie against one end face of the package and the other pair are folded down against and fixed to two opposite side walls of the package.

In shaping the material web into a tube it is necessary that the material of the web should be mouldable to such a degree that no creases are produced in the tube when the same is shaped. To achieve this mouldability the material must be relatively thin and for this reason the finished shaped packages will be somewhat flexible, which is particularly noticeable when the contents are emptied from the package. This is due to the package walls being subjected in the region which constitutes the gripping area to a pressure when the package is lifted. Owing to the said pressure, the wall will be indented against the contents, as a result of which the volume of the packing container is reduced and it is possible, especially when the package is quite full, for the contents to splash out of the package.

In certain types of packages, in order to prevent this disadvantage, a rigid paper or cardboard stiffening element has been applied to the side of the packing container which is situated opposite the side from which the contents are poured. This method, however, is complicated and uneconomical.

The said disadvantages are overcome by the present invention which is based on the principle that the packing material forming the longitudinal joints overlaps parts of the package walls to such an extent that they reinforce the walls of the package.

The invention is characterized in that the joint formed in the manufacture of the tube between the longitudinal edges of the web is of the overlapping type and that the longitudinal joint in the finished package includes an overlapping portion extending along at least 25% of one sidewall of the package in one direction and extends over the entire side wall in the opposite direction and over the adjoining sidewall panels as far as the transverse seals along the opposed sidewall panels.

Figure 2:
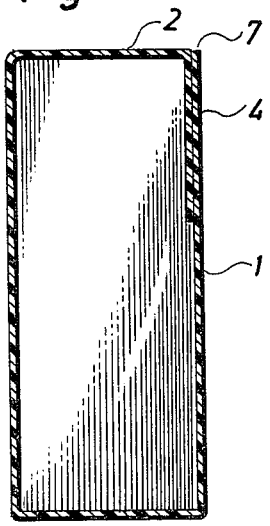

The invention will be described in the following with reference to the enclosed schematic drawing, in which FIG. 1 shows a parallelepipedal package with reinforcement and FIG. 2 shows a cross-section A—A through a parallelepipedal package.

The parallelepipedal packing container shown in FIG. 1 comprises two opposed package walls 1, which form a right angle with the connected side walls 6, two opposed end portions 2, which limit the package formed by the walls 1 and 6, and four flaps 3, two of which are folded to lie against one end face 2 and the other two of which are folded down to lie against the side walls 6 adjacent the region of attachment of the lugs to the package. The package comprises moreover an overlapping joint region 4 and two joint regions 5.

The manufacture of the packing container shown in FIG. 1 occurs when a thermoplastic-coated packing material web is formed into a tube by joining together the longitudinal edges of the material web and sealing them to one another. This is done in such a way that the edges of the packing material web are caused to overlap one another with the inside of one edge overlapping the outside of the other edge, whereupon the thermoplastic material of the edge zones, is heat sealed together. With the object of reinforcing the package in the region which constitutes the gripping area during the emptying of the package, the joint is constituted with such a broad overlap area 4 that this area covers the said gripping area on the one wall 1 and an area of the walls 6 which includes a portion of the folded-down flaps 3.

After forming and filling the tube, the tube is cross-sealed and is shaped by means of a shaping tool designed for the purpose, so that pleats, which constitute the connecting region between the package walls, are formed in the tube. Since considerable inconveniences are inherent in forming the said pleat in the region of the tube which consists of double material layers, it is appropriate for the reinforcement area 4 to be situated in a region below the edge between the wall 1 and the face 2 which contains the pouring opening. By designing the reinforcement area 4 in this way it is only necessary to form an area with double material layer in the folding regions between the wall 1 which contains the reinforcement and the side walls 6. To give the package a pleasing appearance and to make the walls of the container completely smooth on the outside, it is suitable to design the overlapping area so that its edge 7 coincides with the connection between the walls 1 and 6, which comprise the reinforcement 4 and the face 2 which is intended for a pouring opening. The reinforcement area 4 may have a width between 0.5 – 15 cm, but so as to reduce material consumption while at the same time provide sufficient reinforcement a suitable width for this area is 1 – 6 cm.

The cross-sealing of the tube takes place in two parallel regions, so that they are rectangular to the longitudinal direction of the tube, and are heated by means of sealing jaws, whereby the thermoplastic layer of the material web is caused to melt and seal the web goether. After sealing the packages are separated between the two aforementioned parallel regions.

We claim:

1. A parallelepipedal package having opposed end walls, opposed front and rear walls and opposed side walls adjoining said other walls, each side wall having a medial longitudinal face to face seal extending between said end walls and folded against a side wall of said package, one of said front and rear walls being provided with an overlappingly sealed portion extending transversely of said package across said one wall and extending from the edges of said one wall to said medial longitudinal face to face seal of each side wall.

2. A parallelepipedal package having opposed end walls, opposed front and rear walls and opposed side walls adjoining said other walls, each side wall having a medial longitudinal face to face seal extending between said end walls and folded against a wall of said package, one end wall of said package being provided with an integral portion transversely underlying and overlappingly sealed to at least 25% of said front wall and at least 25% of each side wall from said front wall to said medial face to face seal.

3. A parallelepipedal package as claimed in claim 2 wherein said end walls comprise a top wall and a bottom wall, and one end of each medial face to face seal forms a flap folded inwardly against the bottom wall and the other end of each seal being folded downwardly against the juxtaposed side wall.

4. A parallelepipedal package as claimed in claim 2 wherein said package is provided with a pouring opening in that end wall provided with the integral portion.

* * * * *